US005544422A

United States Patent [19]

Leitenberger

[11] Patent Number: 5,544,422

[45] Date of Patent: Aug. 13, 1996

[54] DRYING SECTION

[75] Inventor: Werner Leitenberger, Schlier-Wetzisreute, Germany

[73] Assignee: Voith Sulzer Papiermaschinen GmbH, Heidenheim, Germany

[21] Appl. No.: 377,333

[22] Filed: Jan. 24, 1995

[30] Foreign Application Priority Data

Feb. 1, 1994 [DE] Germany ..... 44 02 928.4

[51] Int. Cl.[6] ..... F26B 11/02

[52] U.S. Cl. ..... 34/117; 34/116; 34/118; 226/92

[58] Field of Search ..... 34/116, 117, 118; 226/92

[56] References Cited

U.S. PATENT DOCUMENTS

| | | | |
|---|---|---|---|
| 3,309,781 | 3/1967 | Boadway | 34/116 |
| 4,183,148 | 1/1980 | Koski et al. | 34/116 |
| 4,835,881 | 6/1989 | Welsby | 34/117 |
| 4,934,067 | 6/1990 | Wedel . | |
| 4,982,513 | 1/1991 | Loser et al. | 34/116 |
| 5,063,689 | 11/1991 | Sollinger | 34/118 |
| 5,184,408 | 2/1993 | Kotitschke et al. | 34/117 |
| 5,377,892 | 1/1995 | Kimball | 226/92 |
| 5,404,653 | 4/1995 | Skaugen et al. | 34/117 |
| 5,416,980 | 5/1995 | Ilvespää | 34/116 |

FOREIGN PATENT DOCUMENTS

| | | |
|---|---|---|
| 249450 | 2/1964 | Australia . |
| 517286 | 12/1992 | European Pat. Off. . |
| 4201107 | 8/1992 | Germany . |

*Primary Examiner*—John M. Sollecito
*Assistant Examiner*—Steve Gravini
*Attorney, Agent, or Firm*—Greenblum & Bernstein, P.L.C.

[57] ABSTRACT

Drying section. A drying section of a papermaking machine, is comprised of several drying groups, wherein the last drying cylinder of one drying group is arranged a short distance from the first drying cylinder of the following drying group and wherein the paper web extends directly from the last drying cylinder to the first drying cylinder, thereby permitting quick transfer of the paper web, between the drying groups.

12 Claims, 1 Drawing Sheet

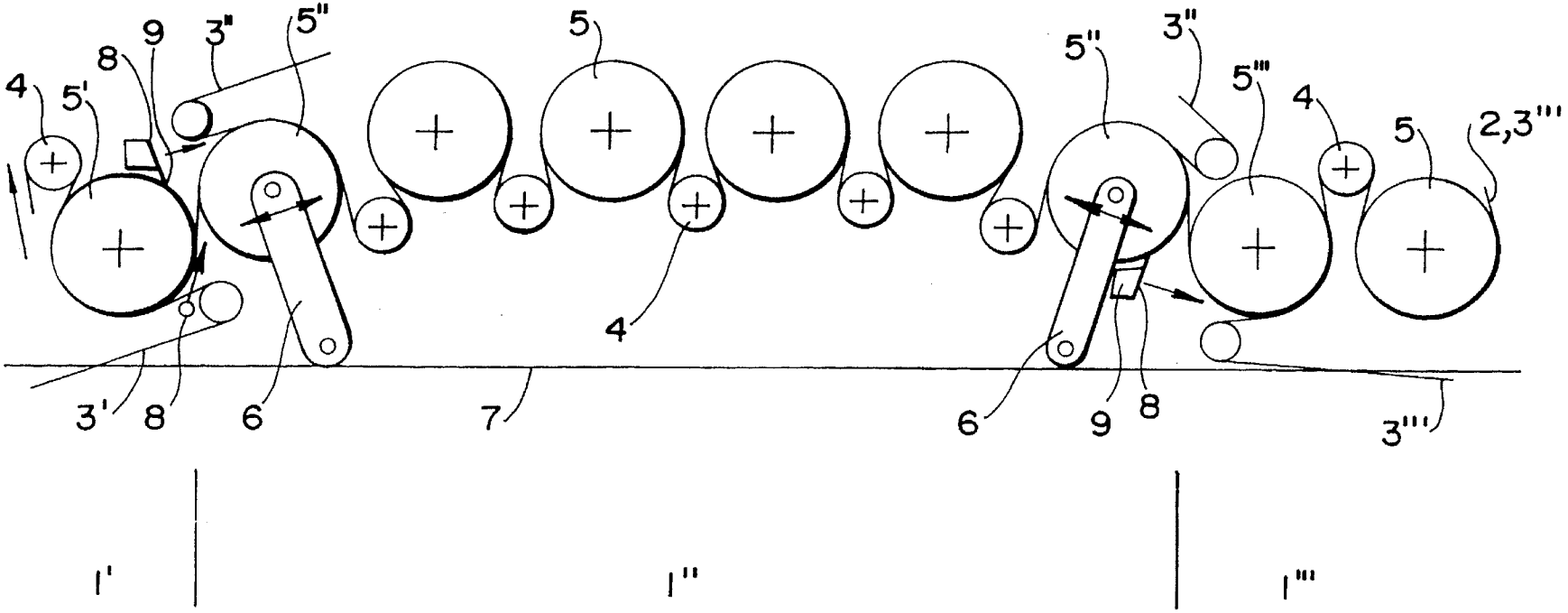
Figure

DRYING SECTION

This application claims the priority of German Patent Application No. DE P 44 02 928.4, filed Feb. 1, 1994, the disclosure of which is incorporated herein by reference in its entirety.

BACKGROUND OF THE INVENTION

1. Field of the Invention

This invention pertains to the drying section of a papermaking machine, the drying section being comprised of several drying groups, a paper web, wherein the paper web, together with at least one endless dry sieve associated with each of the several drying groups, is alternately guided over reversing rolls and heated by drying cylinders, with the paper web being located between the dry sieves and the drying cylinders, and wherein within each drying group only one side of the paper web comes into contact with the drying cylinders, with the side being reversed between each drying group.

2. Discussion of the Background of the Invention and Material Information

U.S. Pat. No. 4,934,067 to Wedel sets forth a drying section for a papermaking machine in which the drying groups are so connected that the dry sieves of both successive groups are brought together at the transition region and come into contact with the web that is situated therebetween. At the same time, the dry sieves of both drying groups are guided over suction rolls that are arranged after the last and before the first drying cylinder.

A device or arrangement of the noted type permits no speed differential between the dryer groups and thus does not permit the possibility of adjusting the web tension. In addition, in the area of mutual contact, there is increased wear of the dry sieves during an eventual tearing of the web.

German Patent Publication DE-PS 4201107 suggests a solution therefor, in which there is a minimal distance between the sieve or screen bands. The transfer of the paper web from one sieve band to the other is also aided via blower unit.

However, the previously noted solution is still unsatisfactory due to the high costs associated with the transfer between the drying groups.

It is the task or object of this invention to produce a drying section having minimal costs associated with the transfer of the web between the drying groups; which permits control of the web tension via the speed differential between the drying groups; and has only a short free draw between the drying groups.

SUMMARY OF THE INVENTION

The task or object of this invention is achieved via the apparatus set forth in the appended claims. Specifically, a first embodiment of a drying section of a papermaking machine of this invention is comprised of several drying groups, a paper web, wherein the paper web, together with at least one endless dry sieve associated with each of the several drying groups, is alternately guided over reversing rolls and heated by drying cylinders, with the paper web being located between the dry sieves and the drying cylinders, and wherein within each drying group only one side of the paper web comes into contact with the drying cylinders, with the side being reversed between each drying group, wherein the last drying cylinder of one drying group is arranged at a short distance from the first drying cylinder of the following drying group, and wherein the paper web extends directly from the last drying cylinder to the first drying cylinder.

In another embodiment of the drying section of this invention, at least one of the last drying cylinder of one drying group and the first drying cylinder of a following drying group is movably arranged for changing the distance between the last and the first drying cylinders.

In a further embodiment of the drying section of this invention, the drying cylinders of one drying group are arranged at substantially the same height within the one drying group, with the heights, above a machine base plane, varying from drying group to drying group, and wherein one of the first and the last drying cylinders of one of two adjacent drying groups thereof is located at about the midpoint between the heights of the drying cylinders of both adjacent drying groups.

In a different embodiment of the drying group of this invention, the distance between the last drying cylinder of one drying group and the first drying cylinder of the following drying group is less than 80 mm.

In still another embodiment of the drying group of this invention, the paper web at the first and last drying cylinders of two adjacent drying groups is not in contact over the entire envelopment region thereof with the respective dry sieve of each drying group.

A yet further embodiment of the drying group of this invention includes a blower unit, with the blower unit assisting the insertion of the paper web between an associated dry sieve and drying cylinder.

Since the last drying cylinder of a drying group is arranged at a short distance relative to the first drying cylinder of the following or subsequent drying group and since the paper web extends directly from the last to the first drying cylinder, it permits, first, an open draw and thereby minimizes the danger of web tearing and secondly, a reduction of both the space requirement of the drying section and the overall costs by eliminating two suction rolls with reference to known solutions of this problem.

It is thus advantageous when the distance between the transferring and the receiving drying cylinders can be variably adjusted via the movable journalling of at least one of the two drying cylinders. Depending upon the circumstances, not only can the length of the free draw of the paper path be determined, but also the following drying group can be completely severed. It has been determined that it is particularly advantageous when the distance between the two noted drying cylinders is less than 80 mm.

In order to avoid a paper jam during a possible paper web tear in the drying groups whose drying cylinders are arranged at substantially the same height within the one drying group, wherein the heights above the machine base plane, vary from drying group to drying group, the first and the last drying cylinder of one of the two adjacent drying groups should be located at about the midpoint between the heights of the drying cylinders of both drying groups. In addition, it is an advantage when the paper web, at the first and last drying cylinder of two adjacent drying groups is not in contact over the entire envelopment region thereof with the respective dry sieve of the drying group. This permits an arrangement of sieve guide rolls which causes no paper jam after a web tear and which assure the passage of the paper web into the paper machine vault.

As an aid for the insertion of the paper web, blower units are preferably utilized.

BRIEF DESCRIPTION OF THE DRAWING

The invention will be better understood and objects other than those set forth above will become apparent when consideration is given to the following detailed description thereof. Such description makes reference to the annexed drawing wherein:

The drawing, in its single FIGURE shows a schematic side view of a portion of a drying section of a paper machine.

DETAILED DESCRIPTION OF THE PREFERRED EMBODIMENTS AND BEST MODE

With respect to the drawing it is to be understood that only enough of the construction of the invention and the surrounding environment in which the invention is employed have been depicted therein, in order to simplify the illustrations, as needed for those skilled in the art to readily understand the underlying principles and concepts of the invention.

The drying section of the papermaking machine of this invention is comprised of several drying groups 1', 1" and 1'" in which a paper web or path 2, together with at least one endless, porous dry sieve or screen 3', 3" or 3'", associated with each of the several drying groups, is alternately guided over reversing rolls 4, preferably of the suction type, and heated by drying cylinders 5, 5', 5" or 5'". In the noted construction, the drying cylinders 5 are arranged at substantially the same height within the one drying group, with the heights, above the machine base plane 7, varying from drying group to drying group. At the same time, paper web 2 is located between the respective drying cylinder 5, 5', 5" and 5'" and the associated dry sieve 3', 3" and 3'" wherein, in drying groups 1', 1" and 1'" only one side of the paper web 2 comes into contact with drying cylinders 5, 5', 5" and 5'" with the side being changed or reversed between the drying groups. It is important that the last drying cylinder 5' and 5" of one drying group 1', 1" is arranged at a short distance from the first drying cylinder 5" or 5'" of the following drying group 1" and 1'" and that the paper web extends directly, that is without having to pass over additional devices, from the last drying cylinder 5' and 5" to the first drying cylinder 5" or 5'". Thereby, it becomes possible to connect the drying groups together in the shortest possible space.

Due to the short distance between the adjacent drying cylinders 5', 5" and 5'" the web tension can also be changed or adjusted by varying the speed of drying groups 1', 1" and 1'".

A positive effect is also achieved when at least one of the adjacent drying cylinders 5', 5" and 5'" is movably mounted so as to permit varying of the distance therebetween. This can readily be accomplished in that the relevant drying cylinder 5" is journalled on both sides in an electromechanically adjustable arm or lever 6. The distance or spacing of the adjacent drying cylinders 5', 5" and 5" 5'" should be adjustable therewith at least within a range of up to 80 min.

In order to counteract against a paper jam at an eventual web tear, at least one of two adjacent drying cylinders 5", preferably one of the movably mounted drying cylinders, is located at about the midpoint between the heights of drying cylinders 5, 5', 5'" of the two drying groups 1', 1" and 1", 1'" In addition thereto, paper web 2, for the same reason, is not in contact over the entire enveloped region of the respective dry sieve 3', 3" and 3'" of the drying cylinders 5', 5" and 5'". As can readily be seen in the drawing FIGURE, with a short free draw between the drying groups and the largest possible contact area with drying sieve 3', 3" and 3'" vertical removal of the torn paper web 2, into the machine vault, can be accomplished.

To aid in the insertion of paper web 2 into the drying section, blower units 8 are utilized, with blower units 8, in some instances, also being attached at scraper mechanisms 9 for aiding in the stripping off of paper web 2.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A drying section of a papermaking machine, said drying section being comprised of several drying groups, a paper web, wherein said paper web, together with at least one endless dry sieve associated with each of the several drying groups, is alternately guided over reversing rolls and heated by drying cylinders, with the paper web being located between the dry sieves and the drying cylinders, wherein within each drying group only one side of the paper web comes into contact with the drying cylinders, with the side being reversed between each drying group, with the paper web extending directly from a last drying cylinder of one drying group to a first drying cylinder of a following drying group, wherein the last drying cylinder of the one drying group is arranged at a short distance from the first drying cylinder of the following drying group, and wherein at least one of the last drying cylinder of the one drying group and the first drying cylinder of the following drying group is movably arranged for changing the distance between said last and said first drying cylinders.

2. The drying section of claim 1 wherein the drying cylinders of one drying group are arranged at substantially the same height within the one drying group, with the heights, above a machine base plane, varying from drying group to drying group, and wherein one of the first and the last drying cylinders of one of two adjacent drying groups thereof is located at about the midpoint between the heights of the drying cylinders of both adjacent drying groups.

3. The drying group of claim 2 wherein the distance between the last drying cylinder of one drying group and the first drying cylinder of the following drying group is less than 80 mm.

4. The drying group of claim 2 wherein the paper web at the first and last drying cylinders of two adjacent drying groups is not in contact over the entire envelopment region thereof with the respective dry sieve of each drying group.

5. The drying group of claim 4, further including a blower unit, with said blower unit assisting the insertion of the paper web between an associated dry sieve and drying cylinder.

6. The drying group of claim 1 wherein the distance between the last drying cylinder of one drying group and the first drying cylinder of the following drying group is less than 80 mm.

7. The drying group of claim 1 wherein the paper web at the first and last drying cylinders of two adjacent drying groups is not in contact over the entire envelopment region thereof with the respective dry sieve of each drying group.

8. The drying group of claim 7, further including a blower unit, with said blower unit assisting the insertion of the paper web between an associated dry sieve and drying cylinder.

9. A drying section of a papermaking machine, said drying section being comprised of several drying groups, a paper web, wherein said paper web, together with at least one endless dry sieve associated with each of the several drying groups, is alternately guided over reversing rolls and heated by drying cylinders, with the paper web being located between the dry sieves and the drying cylinders, wherein within each drying group only one side of the paper web comes into contact with the drying cylinders, with the side being reversed between each drying group, with the paper web extending directly from a last drying cylinder of one drying group to a first drying cylinder of a following drying group, wherein the last drying cylinder of the one drying group is arranged at a short distance from the first drying cylinder of the following drying group, and wherein the drying cylinders of one drying group are arranged at substantially the same height within the one drying group, with the heights, above a machine base plane, varying from drying group to drying group, and wherein one of the first and the last drying cylinders of one of two adjacent drying groups thereof is located at about the midpoint between the heights of the drying cylinders of both adjacent drying groups.

10. The drying group of claim 9 wherein the distance between the last drying cylinder of one drying group and the first drying cylinder of the following drying group is less than 80 mm.

11. The drying group of claim 9 wherein the paper web at the first and last drying cylinders of two adjacent drying groups is not in contact over the entire envelopment region thereof with the respective dry sieve of each drying group.

12. The drying group of claim 11, further including a blower unit, with said blower unit assisting the insertion of the paper web between an associated dry sieve and drying cylinder.

* * * * *